United States Patent [19]

Coller et al.

[11] Patent Number: 4,470,653

[45] Date of Patent: Sep. 11, 1984

[54] LATCHING DEVICE FOR SECURING STACKED PRINTED CIRCUIT BOARDS TOGETHER

[75] Inventors: James R. Coller, Carlisle; Joseph S. DiOrazio, Harrisburg, both of Pa.

[73] Assignee: AMP Incorporated, Harrisburg, Pa.

[21] Appl. No.: 406,682

[22] Filed: Aug. 9, 1982

[51] Int. Cl.[3] ..... H01R 13/20

[52] U.S. Cl. ..... 339/74 R; 339/17 M

[58] Field of Search ..... 339/176 MP, 75 MP, 74 R, 339/17 LM, 17 M, 47 R, 49 R

[56] References Cited

U.S. PATENT DOCUMENTS

| | | | |
|---|---|---|---|
| 3,426,313 | 2/1969 | Wycheck | 339/74.9 |
| 3,587,031 | 6/1971 | Flavin | 339/75 MP |
| 3,638,033 | 1/1972 | Johnson et al. | 339/17 LM |
| 4,332,431 | 6/1982 | Bobb et al. | 339/74 R |

*Primary Examiner*—Joseph H. McGlynn
*Assistant Examiner*—Thomas M. Kline
*Attorney, Agent, or Firm*—Allan B. Asborne

[57] ABSTRACT

The present invention relates to a device for securing stacked printed circuit boards together utilizing signal transferring connectors mounted on the boards. More particularly, the device includes depending pins having grooves thereon and movable latching means on the connector, said means engaging the grooves to releasably latch the board and connector together.

3 Claims, 6 Drawing Figures

16
44
22
68
24
10
22
24
32
14
18
36
42
64
58
40
34
66
60
12
65
56
26
28
38
53
52
58
64
60
60
18
30
62
56
40
46
54
38
50
53
52
48

LATCHING DEVICE FOR SECURING STACKED PRINTED CIRCUIT BOARDS TOGETHER

BACKGROUND OF THE INVENTION

1. Field of the Invention

The invention disclosed herein relates to devices for securing stacked printed circuit boards together so that vibrational and other similar forces cannot cause them to work apart.

2. Prior Art

Currently, stacked boards are strapped together.

SUMMARY OF THE INVENTION

The present invention includes pins and latching means with the pins having circumferential grooves and the latching means having arms which are received in the grooves. The pins depend directly from the overlying board or from a connector mounted on the overlying board. The latching means are mounted on a connector on an underlying board and are axially movable. Preferrably, pin receptacles are positioned on the ends of the connector into which the pins enter for latching engagement with the arms.

DESCRIPTION OF THE INVENTION

Figure 1:
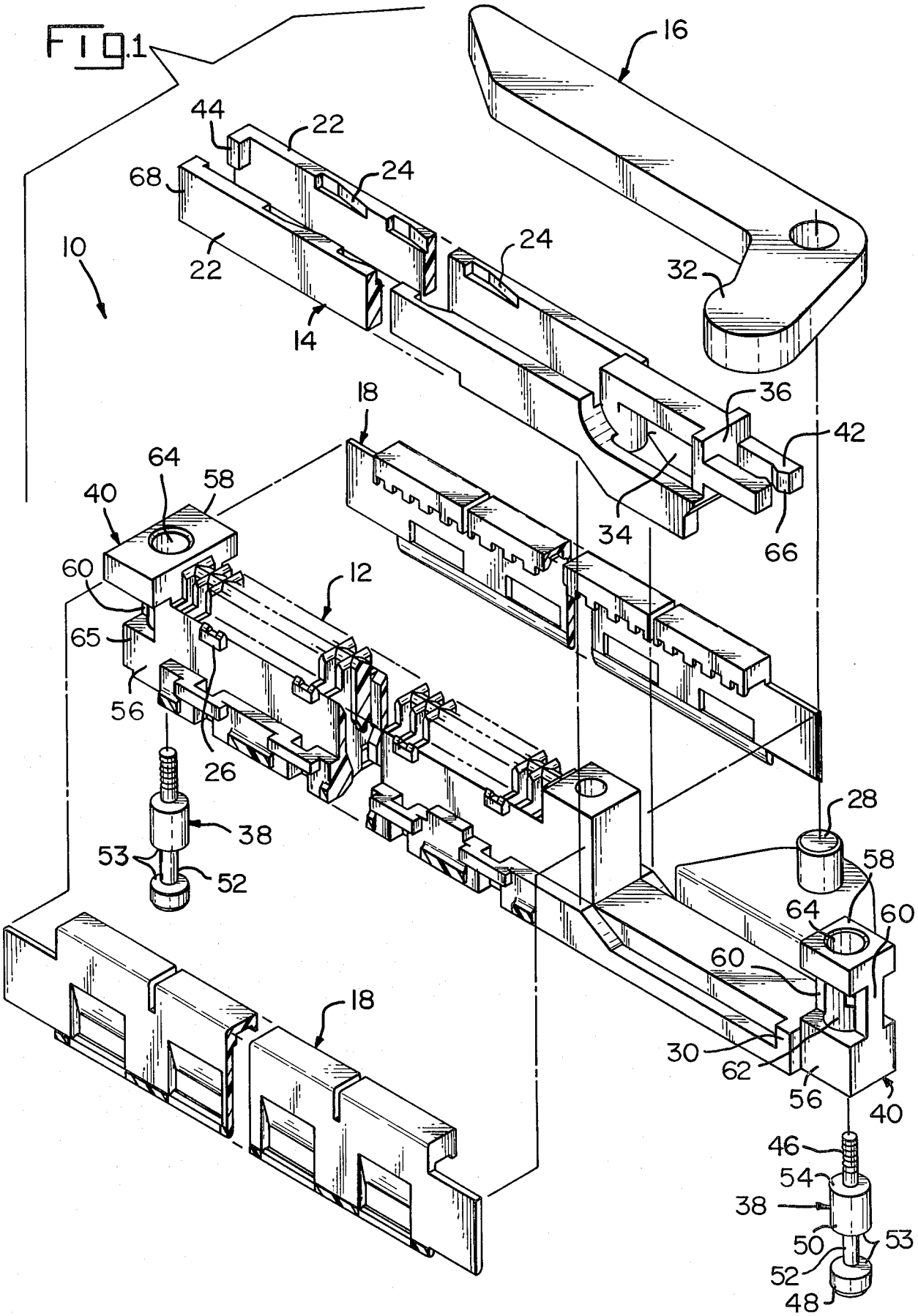
FIG. 1 is an isometric view of a connector utilizing the latching device of the present invention to latch or secure stacked printed circuit boards together.
Figure 2:
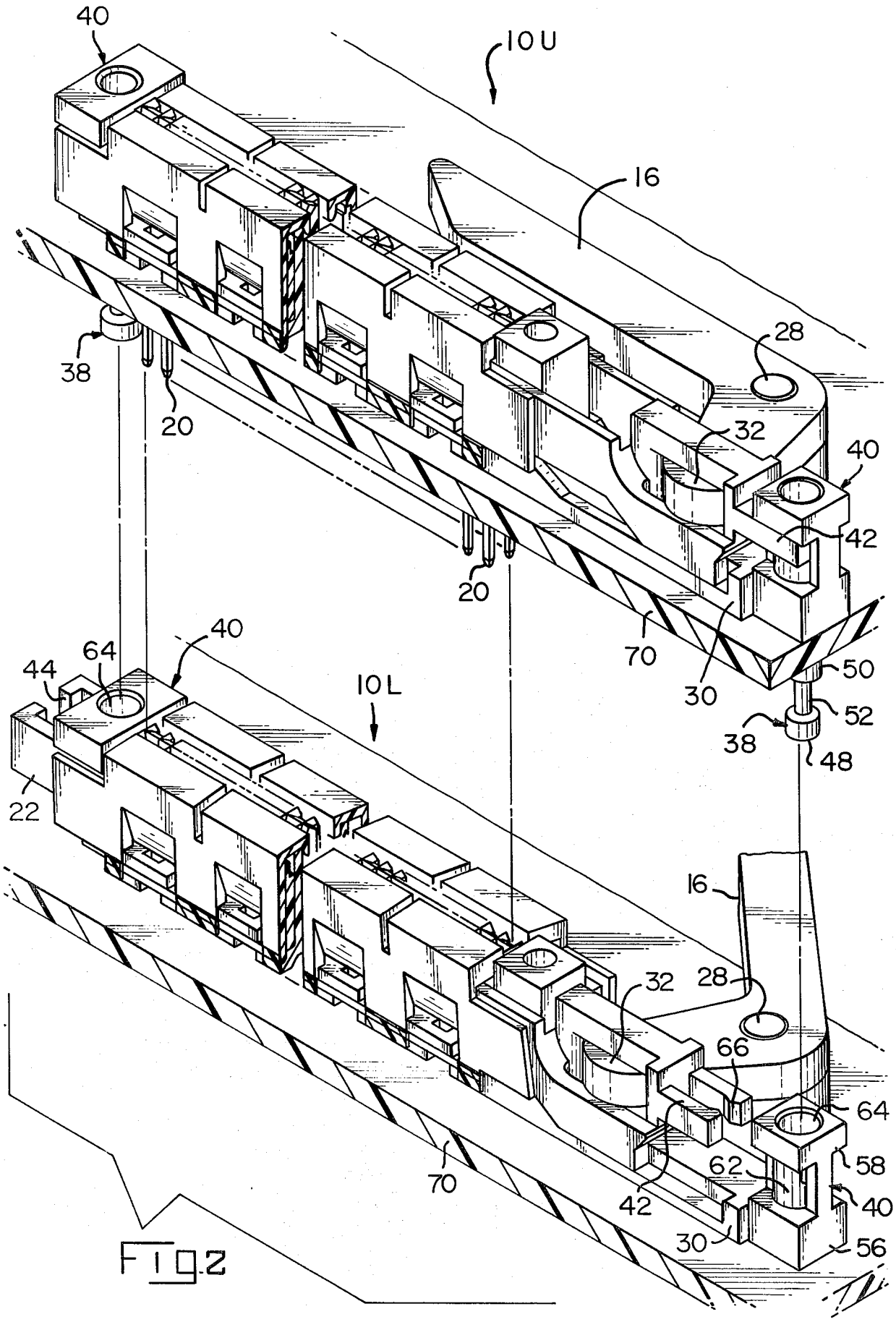
FIG. 2 is an isometric view of the connector of FIG. 1 mounted on printed circuit boards to illustrate the latching device of FIG. 1.

Connector 10, shown in exploded fashion in FIG. 1, is disclosed in U.S. Pat. No. 4,332,431. The components of connector 10 include housing 12, cam 14, lever 16 and shrouds 18. Contact elements or terminals which transfer signals and power between stacked circuit boards, are positioned in cavities in housing 12 (not shown). The leads comprising the lower ends thereof are seen in FIG. 2 and are referenced by numeral 20.

Cam 14 is positioned on housing 12 with cam blades 22 on the cam positioned on each side. Ramps 24 on the blades cooperate with projections 26 on the housing so that the blades are deflected outwardly as the cam is moved longitudinally.

Shrouds 18 are mounted on the housing over the cam blades and are capable of being pivotted outwardly by the cam blades with the pivot point being at the shroud's lower edge. The shroud's upper edges catch and pull the contact elements or terminals outwardly so that leads may be freely inserted into the connector.

Lever 16, pivotally mounted on pin 28 adjacent front end 30 of housing 12, includes a toe 32 which is received in slot 34 located near the front end 36 of cam 14. The cam is thusly moved longitudinally by rotating the lever.

FIG. 2 shows an assembled upper connector 10-u and lower connector 10-l. The upper connector is closed; i.e., cam 14 has been moved forwardly. The lower connector is open; i.e., cam 14 is moved rearwardly to pivot shrouds 18 outwardly. Leads 20 may be freely inserted into the housing cavities without interference by the contact elements which have been pulled out of the way by the shrouds. Reference to U.S. Pat. No. 4,332,431 may be made for a more detailed explanation.

With reference to FIG. 1, the device of the present invention includes a pair of pins 38, receptacles 40 projecting outwardly from each end of housing 12, and arms 42 and blocks 44 provided on cam 14.

Pins 38 are threaded at end 46, have an enlarged head 48 and an enlarged intermediate section 50 spaced from the head to define a circumferential groove 52 having spaced-apart facing shoulders 53. The junction between threaded end 46 and intermediate section 50 provides shoulder 54. Preferrably, the pins are made from stainless steel. Diametrically opposed slots could be substituted for groove 52. The grooves, however, eliminate an orientation problem as will be apparent below.

Receptacles 40 include base 56 and overlying plate 58 supported by vertical support members 60. Aligned passages 62 and 64 extend through base 56 and plate 58 respectively. Nuts (not shown) are emplaced in passages 62 adjacent their lower or downwardly facing openings in bases 56. Alternatively, the threaded ends may be self-tapping, thus removing the need for nuts. The vertical support members at the front end 30 of housing 14 are two in number and are positioned in line with the longitudinal axis of the housing. Only one support member 60 is required at the back end 65 of housing 12 in that the plate is also supported by the housing proper.

Two parallel, spaced-apart arms 42 extend forwardly from front end 36 of cam 14. Inwardly projecting, beveled members 66 are provided on the free ends of each arm.

The aforementioned blocks 44 are provided on each blade 22 at rear end 68 of cam 14. The blocks face inwardly and are located adjacent the top edge of each blade. The arms and blocks constitute the latching means.

The two connectors shown in FIG. 2 illustrate the present invention. A connector; e.g., connector 10-u, is mounted on printed circuit board 70 with the leads 20 extending through the board. Pins 38 are threaded into receptacles 40 from below the board. Shoulder 54 on the bolts abutt the underside of the board to secure the connector to the board.

With a connector being open; e.g., connector 10-l, cam 14, and more particularly arms 42 and blocks 44 are moved back from receptacles 40. Pins 38 and leads 20 from an overlying connector; e.g., connector 10-u, may be freely inserted into receptacles 40 and the cavities in housing 12. When completely positioned, heads 48 of the pins will be in passages 62 in bases 56, intermediate section 50 will be in passage 64 in plate 58, and grooves 52 in the space between the plate and the base.

Figure 3:
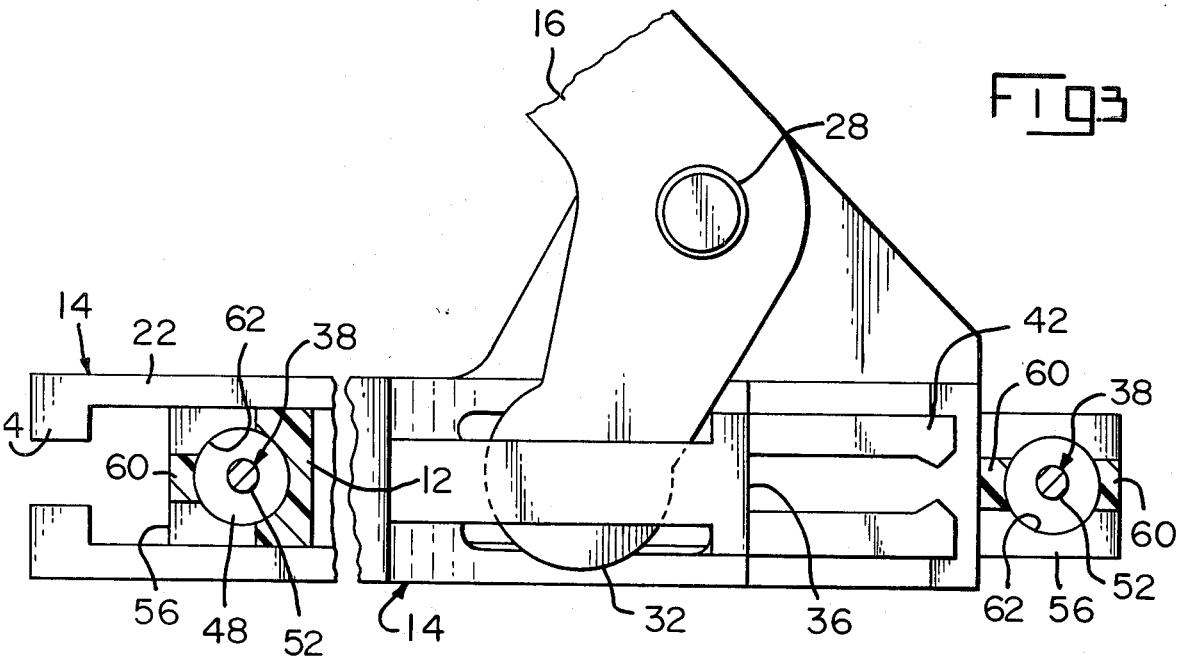
FIGS. 3 and 4 are top plan views illustrating the operation of the latching device of FIG. 1.

FIG. 3 is a top plan view showing the pins in the passages and the arms 42 and blocks 44 moved backed from receptacles 40.

Upon pivoting lever 16 rearwardly, cam 14 is moved forwardly to close the connector; e.g., connector 10-u. Arms 42 and blocks 44 are moved into the space between bases 56 and plate 58 in receptacles 30 and more particularly, into groove 52 on pins 38. Accordingly, the pins are locked in by the latching means and cannot be withdrawn.

Figure 4:
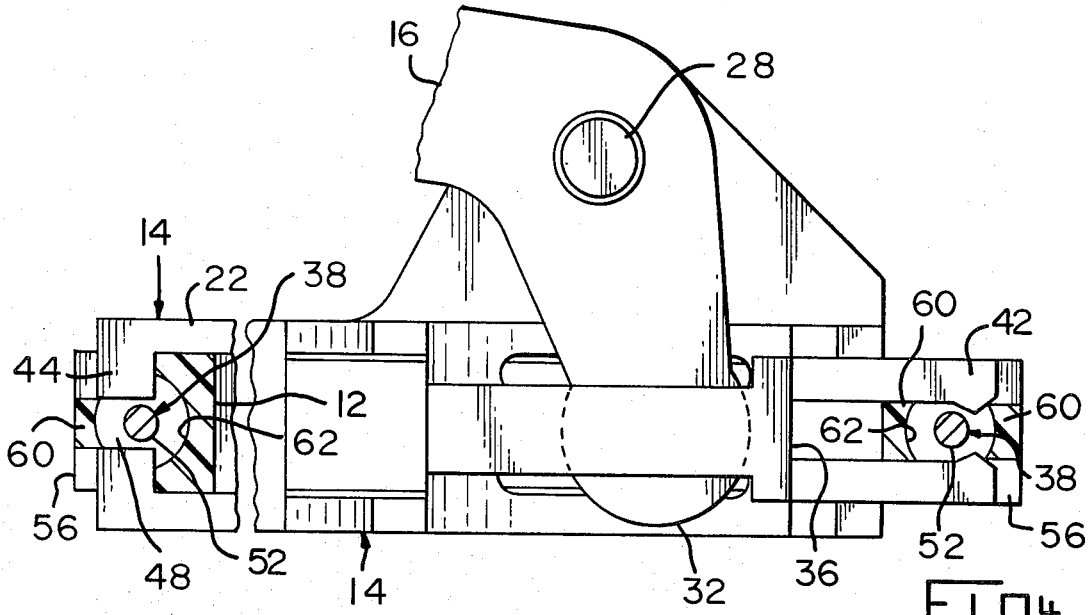

FIG. 4 is a top plan view showing arms 42 and blocks 44 moved into receptacles 30 and locking pins 38 therein.

Figure 5:
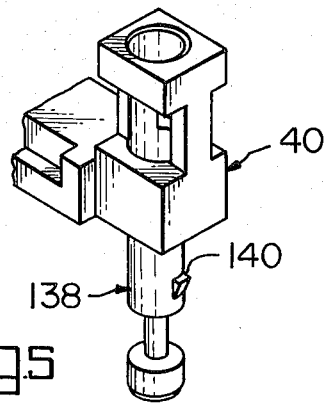
FIG. 5 is an isometric view of another and preferred embodiment of the present invention.

FIG. 5 is an isometric view illustrating a preferred modification. Pin 38 shown in FIGS. 1 and 2 is replaced by pin 138 in the FIG. 5 embodiment. Pin 138 is part of the molding and not a separate component. A resilient ear 140 on the pin catches on the underside of the board on which the connector is mounted to retain the connector thereon. Pin 138 is alike in all other structural features.

Figure 6:
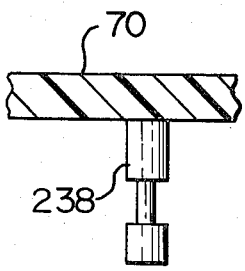
FIG. 6 is a view illustrating another embodiment of the present invention.

Another modification shown in FIG. 6, is where a pin 238 is attached directly to the board and not to the connector. Conventional means (not shown) would be used to make the attachment.

The latching device of the present invention has been illustrated with one particular connector. It should be clear to those skilled in the art that other connectors can be utilized as well.

We claim:

1. A latching device for securing an upper circuit board to a lower circuit board comprising:

a. one or more pins depending from the upper circuit board, said pins having along their length, spaced-apart, facing shoulders; and b. movable arms on an axially movably component on a connector mounted on the lower circuit board and adapted for sliding in between the spaced-apart, facing shoulders on the pins to secure the two boards together.

2. The latching device of claim 1 further including receptacles positioned on the connector into which said pins enter from one direction and into which said movable arms enter at right angles to said pins so as to slide in between the facing shoulders.

3. The latching device of claim 1, wherein said pins are attached to a connector mounted on the upper circuit board and extend downwardly through the board.

* * * * *

UNITED STATES PATENT AND TRADEMARK OFFICE

CERTIFICATE OF CORRECTION

PATENT NO. : 4,470,653

DATED : September 11, 1984

INVENTOR(S) : James R. Coller et al.

It is certified that error appears in the above-identified patent and that said Letters Patent is hereby corrected as shown below:

The title page showing the illustrative figure should be deleted to appear as per attached title page.

On the title page, the name of the attorney should read

-- Allan B. Osborne --.

Signed and Sealed this

*Sixth* Day of *August 1985*

[SEAL]

*Attest:*

DONALD J. QUIGG

*Attesting Officer*

*Acting Commissioner of Patents and Trademarks*

United States Patent [19]
Coller et al.
[11] Patent Number: 4,470,055
[45] Date of Patent: Sep. 11, 1984

[54] LATCHING DEVICE FOR SECURING STACKED PRINTED CIRCUIT BOARDS TOGETHER

[75] Inventors: James R. Coller, Carlisle; Joseph S. DiOrazio, Harrisburg, both of Pa.

[73] Assignee: AMP Incorporated, Harrisburg, Pa.

[21] Appl. No.: 406,682

[22] Filed: Aug. 9, 1982

[51] Int. Cl.³ ..... H01R 13/20
[52] U.S. Cl. ..... 339/74 R; 339/17 M
[58] Field of Search ..... 339/176 MP, 75 MP, 74 R, 339/17 LM, 17 M, 47 R, 49 R

[56] References Cited

U.S. PATENT DOCUMENTS

| | | | |
|---|---|---|---|
| 3,426,313 | 2/1969 | Wycheck | 339/74.9 |
| 3,587,031 | 6/1971 | Flavin | 339/75 MP |
| 3,638,033 | 1/1972 | Johnson et al. | 339/17 LM |
| 4,332,431 | 6/1982 | Bobb et al. | 339/74 R |

*Primary Examiner*—Joseph H. McGlynn
*Assistant Examiner*—Thomas M. Kline
*Attorney, Agent, or Firm*—Allan B. Asborne

[57] ABSTRACT

The present invention relates to a device for securing stacked printed circuit boards together utilizing signal transferring connectors mounted on the boards. More particularly, the device includes depending pins having grooves thereon and movable latching means on the connector, said means engaging the grooves to releasably latch the board and connector together.

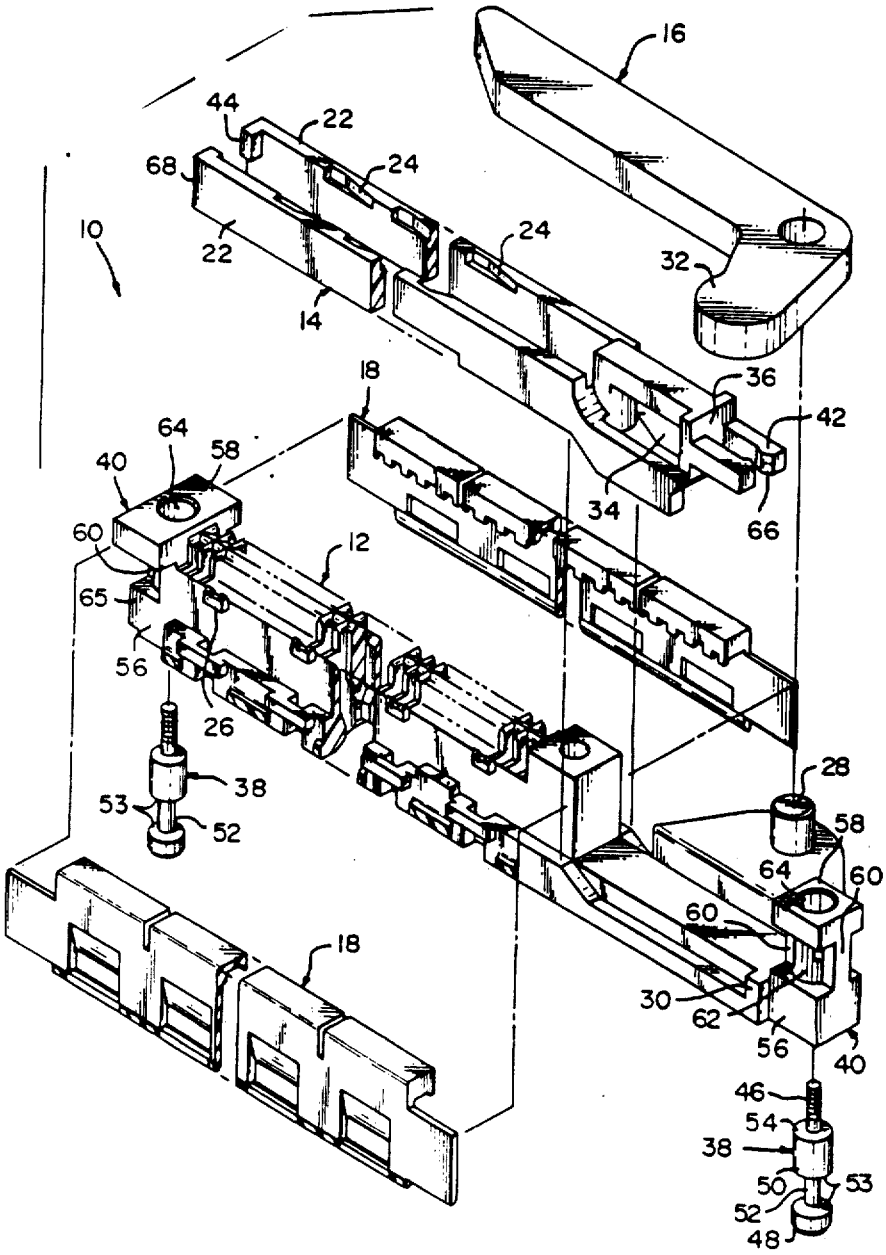

3 Claims, 6 Drawing Figures